US006032945A

United States Patent [19]

Miura

[11] Patent Number: 6,032,945

[45] **Date of Patent: *Mar. 7, 2000**

[54] SHEET TRANSPORT APPARATUS

[75] Inventor: Tsutomu Miura, Yokohama, Japan

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/752,090

[22] Filed: Nov. 20, 1996

[30] Foreign Application Priority Data

Nov. 27, 1995 [JP] Japan ..... 7-307630

[51] Int. Cl.[7] ..... B65H 3/52

[52] U.S. Cl. ..... 271/122; 271/188; 271/272

[58] Field of Search ..... 271/188, 272

[56] References Cited

U.S. PATENT DOCUMENTS

| | | | |
|---|---|---|---|
| 4,188,025 | 2/1980 | Gusfafson et al. | 271/272 X |
| 4,302,002 | 11/1981 | Hashimoto | 271/272 |
| 4,438,918 | 3/1984 | Ito et al. | 271/251 |

FOREIGN PATENT DOCUMENTS

| | | | |
|---|---|---|---|
| 15337 | 1/1985 | Japan | 271/272 |
| 116438 | 5/1987 | Japan | 271/188 |
| 41347 | 2/1988 | Japan | 271/188 |
| 272733 | 11/1988 | Japan | 271/272 |
| 48343 | 2/1990 | Japan | 271/272 |
| 243551 | 10/1991 | Japan | 271/272 |
| 264439 | 11/1991 | Japan | 271/272 |
| 48617 | 2/1994 | Japan | 271/272 |

*Primary Examiner*—Christopher P. Ellis
*Assistant Examiner*—Richard Ridley
*Attorney, Agent, or Firm*—Walter S. Stevens

[57] ABSTRACT

A sheet transport apparatus capable of applying a predetermined force for transporting any kind of paper, including a sheet of thin paper, without forming transport wrinkles in the paper caused by a nipping pressure. The apparatus includes a hard roller 114 and a soft roller 112 for nipping a sheet of paper 10 therebetween. The soft roller is driven to transport the sheet using a frictional force generated from the nipping pressure applied by the soft and hard rollers. The hard roller is in a barrel-shape having a predetermined radial curvature "R", such that the nipping pressure decreases gradually along its axis from the center toward the periphery of a nipping face between two rollers. This causes a compressive stress against the sheet to shift smoothly from a portion of the sheet nipped by the soft and hard rollers to a portion free from the nipping pressure. Thus, the formation of transport wrinkles in the sheet can be prevented.

18 Claims, 6 Drawing Sheets

SHEET TRANSPORT APPARATUS

BACKGROUND OF THE INVENTION

1. Field of the Invention

The present invention relates generally to a sheet transport apparatus. More particularly, the present invention relates to a sheet transport apparatus for use in a copying machine, scanner, printer, facsimile machine, microfilmer, and the like.

2. Description of the Prior Art

Copying machines, printers and facsimile machines are used in a wide variety of applications. A mechanism for transporting sheets of paper is essential for such machines.

A sheet transport apparatus used in such machines includes two relatively-positioned rollers, or a belt and a roller, for nipping a sheet of paper to be transported. Such rollers, or the belt and roller, rotate together to transport the sheet of paper.

FIG. 2 shows such a conventional sheet transport apparatus in which a pair of rollers are nipping a sheet of paper 10. A soft roller 12 is made of a material, such as rubber having a high coefficient of friction, and is connected to a drive source, e.g., a motor, so that soft roller 12 serves as a drive roller. In a position relative to soft roller 12 there is provided a hard roller 14 made of synthetic resin or the like. Typically, soft and hard rollers 12, 14 apply an appropriate nipping force therebetween to thereby increase the force of transporting sheet 10. In other words, a certain pressure is applied to a nipping area where sheet 10 is nipped between soft and hard rollers 12 and 14, respectively.

Thus, soft and hard rollers 12, 14 of the conventional sheet transport apparatus apply a high pressure to sheet 10, so that the nipping area of sheet 10 is pressed with a given pressure. In the meanwhile, an area of the sheet 10 other than the nipping area remains free from pressure. As a result, there is generated a difference in pressure between the nipping area and the free area, which causes distortion to be developed on the inside of sheet 10. This distortion disadvantageously leads to so-called "transportation wrinkles" which are indicated by arrow 16 in FIG. 2.

SUMMARY OF THE INVENTION

It is an object of the present invention to alleviate the above problem by providing a sheet transport apparatus capable of preventing the formation of wrinkles in the paper, including thin or soft paper, caused by a nipping pressure, while maintaining the apparatus's force of transporting the sheets of paper.

The above object will be realized by a sheet transport apparatus, according to one aspect of the present invention, comprising a first friction member for transport and a second friction member for transport abutted against the first friction member, the first and second friction members nipping a sheet of paper therebetween, and rotating together to transport the sheet. A nipping pressure applied to a nipping face between the first and second friction members where the sheet is nipped gradually decreases from the center toward the outer periphery of the nipping face.

Such a gradual decrease of the nipping pressure contributes to suppressing distortion of the sheet caused by the nipping pressure on the inside of the sheet in the sheet transport apparatus in accordance with the first aspect of the present invention.

The sheet transport apparatus, according to a second aspect of the present invention, includes a transport roller as the first friction member and an elastic body as the second friction member. A diameter of the transport roller is made larger at an intermediate position along its axis than in other positions.

The nipping pressure applied to the nipping face increases in the center of the transport roller and decreases toward both ends thereof along its axis due to the design of the transport roller.

The sheet transport apparatus, according to a third aspect of the present invention, includes a transport belt as the first friction member and an elastic body as the second transport member. A thickness of the transport belt is made larger in a widthwise direction at an intermediate position of the transport belt than in other positions.

The nipping pressure applied to the nipping face is therefore high in the center of the transport belt in an axial direction and decreases toward the ends of the transport belt due to the design of the transport belt.

Another aspect of the present invention is a copying machine utilizing a sheet transport apparatus in accordance with the above first through third aspects.

A further aspect of the present invention is a scanner utilizing a sheet transport apparatus in accordance with the above first through third aspects.

Still another aspect of the present invention is a printer utilizing a sheet transport apparatus in accordance with the above first through third aspects.

A still further aspect of the present invention is a facsimile machine utilizing a sheet transport apparatus in accordance with the above first through third aspects.

A still further aspect of the present invention is a microfilmer utilizing a sheet transport apparatus in accordance with the above first through third aspects.

By adapting a sheet transport apparatus according to the first through third aspects of the present invention, it is possible to realize a copying machine, for example, having an improved force for transporting sheets of paper.

BRIEF DESCRIPTION OF THE DRAWINGS

A preferred embodiment of the present invention will be described below in conjunction with the following drawings wherein.

DESCRIPTION OF THE PREFERRED EMBODIMENTS

Figure 1:
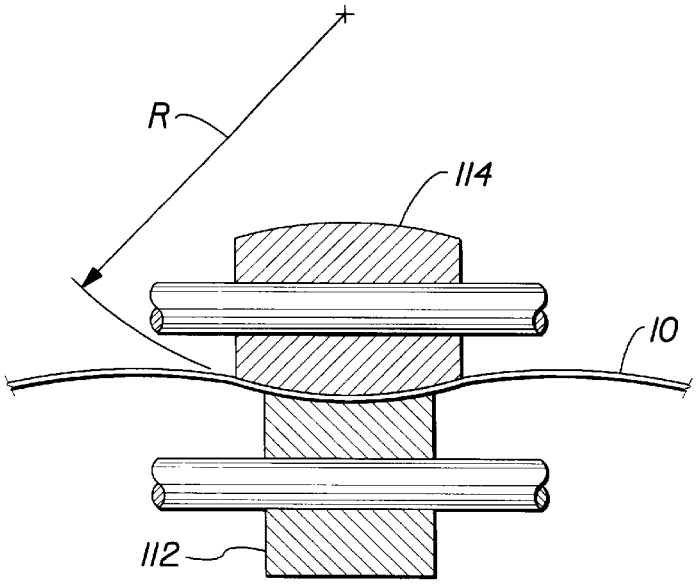
FIG. 1 illustrates an operation of a sheet transport apparatus according to a preferred embodiment of the present invention.

FIG. 1 illustrates a sheet transport apparatus according to a preferred embodiment of the present invention, in which a soft roller 112 and a hard roller 114 nip a sheet of paper 10 therebetween.

Figure 2:
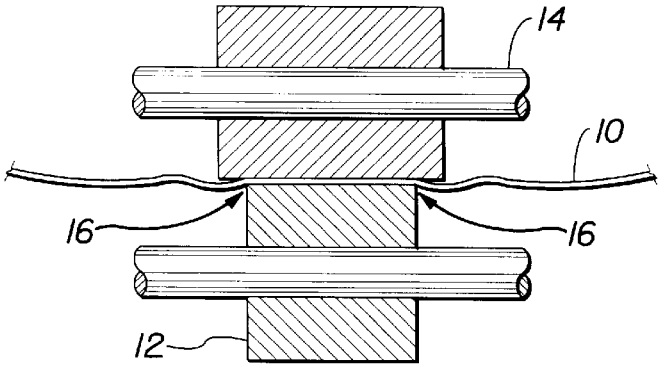
FIG. 2 (PRIOR ART)
FIG. 2 illustrates an operation of a conventional sheet transport apparatus.

A feature of this embodiment is that hard roller 114 is barrel-shaped, rather than having a cylindrical shape of hard roller 14 in FIG. 2, such that a diameter of hard roller 114 changes along its axis, a radial curvature of the diameter change being shown by "R" in FIG. 1. Thus, barrel-shaped hard roller 114 applies a greater pressure (or a nipping pressure) on sheet 10 in a position where the diameter is large than in a position where the diameter is small. In other words, a compressive stress against the thickness of nipped sheet 10 decreases smoothly from the center toward both ends of hard roller 114 about its axis. Formation of transport wrinkles is thereby suppressed to the least possible degree.

Like the conventional soft roller, soft roller 112 is made of an elastic material, such as rubber. During rotation, soft roller 112 changes its shape in compliance with the barrel-shape of hard roller 114.

The embodiment shown in FIG. 1 comprises hard roller 114 and soft roller 112. It is also preferable to apply other conventionally-known structures, such as the combination of a transport belt and a roller, or the combination of transport belts, to the principles of the present invention.

In the case where a transport belt is used, it is advantageous to form the belt so that the center of the belt is thicker in the width direction than other portions. With such a structure, it is possible to decrease the nipping pressure toward the periphery of the belt, while maintaining a high nipping pressure in the center of the belt. The barrel-shaped hard roller 114 can thus be applied to other structures such as the transport belt.

It is also preferable to connically taper the rollers or belts, instead of shaping them like a barrel. In either case, the distortion stress developed on nipped sheet 10 can be dispersed smoothly, thereby effectively preventing the formation of transport wrinkles in sheet 10.

It can be understood from the above description that, according to the first aspect of the present invention, the sheet transport apparatus capable of preventing the formation of transport wrinkles in the sheet is provided, in which the nipping pressure changes smoothly from the nipping face toward other areas of the sheet.

According to the second aspect of the present invention, the sheet transport apparatus of the first aspect can be realized with a simple structure by changing the diameter of the transport roller along its axis so that the diameter is larger in the center than at other portions, thereby facilitating setting the nipping pressure to a high level in the center of the nipping face.

Figure 3:
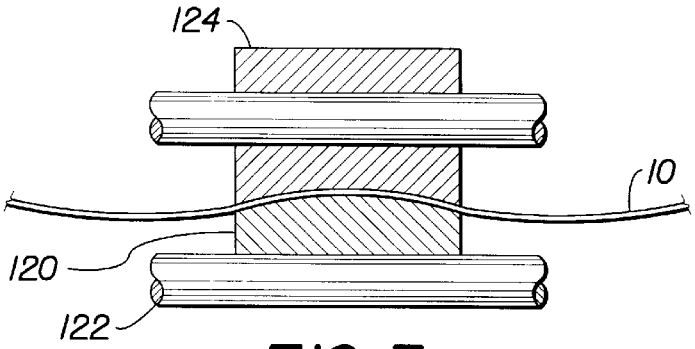
FIG. 3 illustrates an operation of a sheet transport apparatus according to another preferred embodiment of the present invention.

According to the third aspect of the present invention, as illustrated in FIG. 3, a transport belt 120 is made thicker in the center of the belt than in other portions. Belt 120 is supported on a roller 122 and, with a second transport member 124, forms a nip for sheet 10. As a result, it is also possible to realize the sheet transport apparatus with a simple structure by setting the nipping pressure to a high level in the center of the nipping face and decreasing the nipping pressure smoothly toward the outer periphery.

Figure 4:
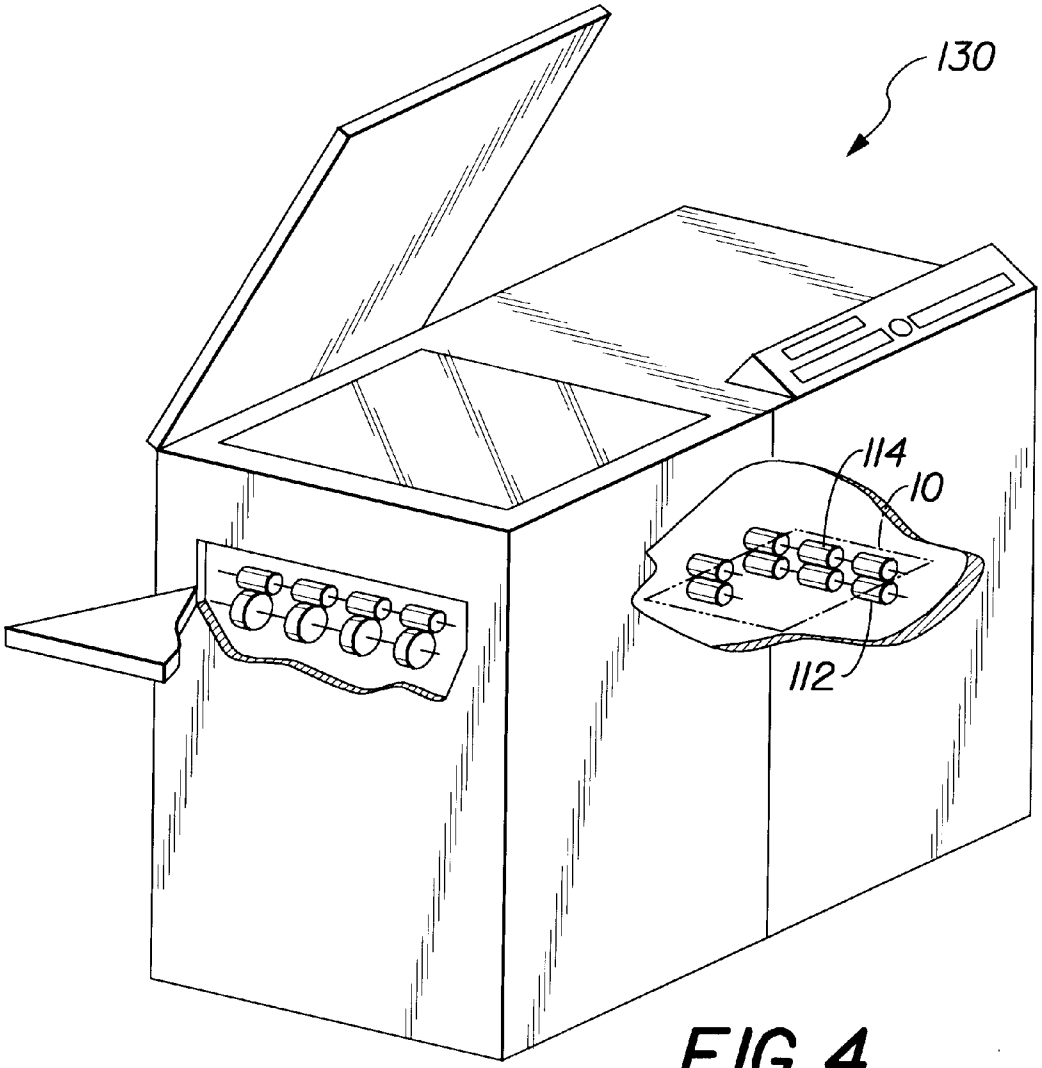
FIG. 4 illustrates a copier.

Referring to FIG. 4, another aspect of the present invention provides a copying machine 130 by adapting the first, second or third aspect above. The copying machine has an increased force of transporting sheets of paper, so that the formation of transport wrinkles can be prevented.

Figure 5:
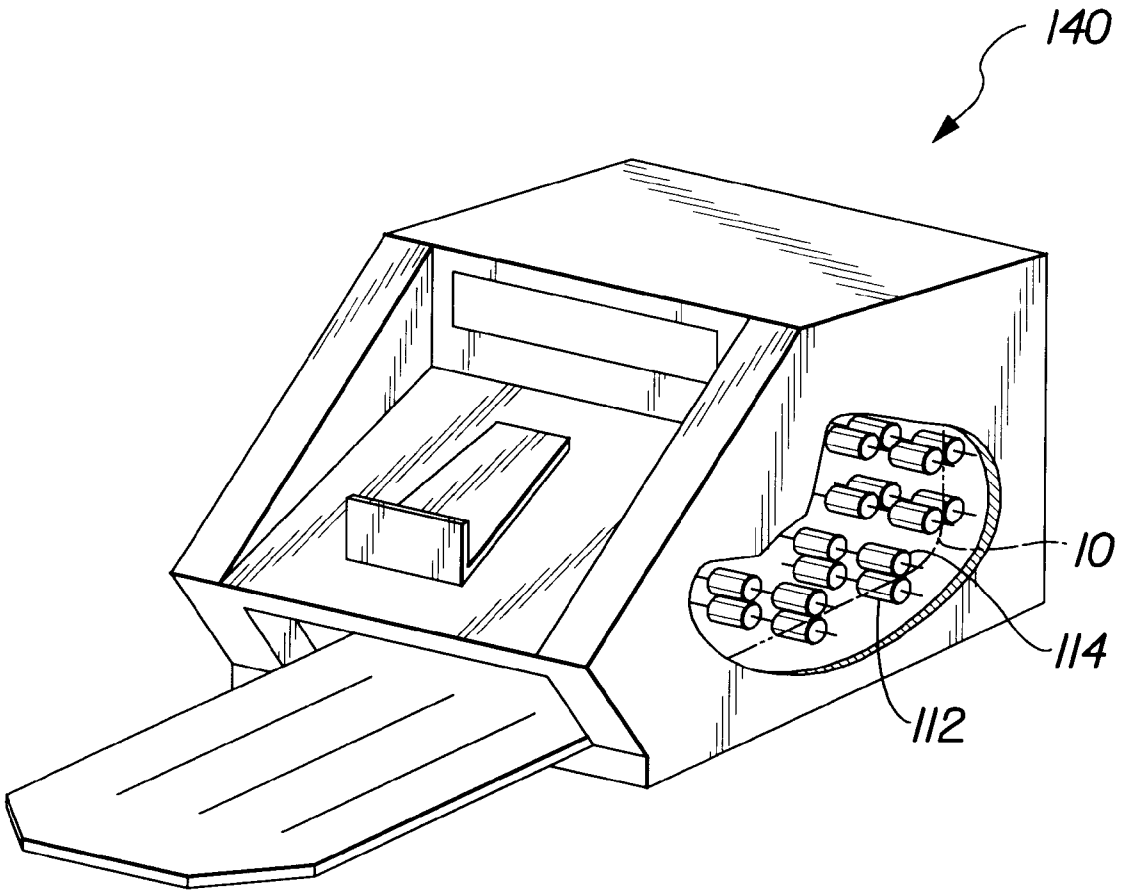
FIG. 5 illustrates a scanner.

Referring to FIG. 5, still another aspect of the present invention provides a scanner 140 having an increased force of transporting sheets of paper.

Figure 6:
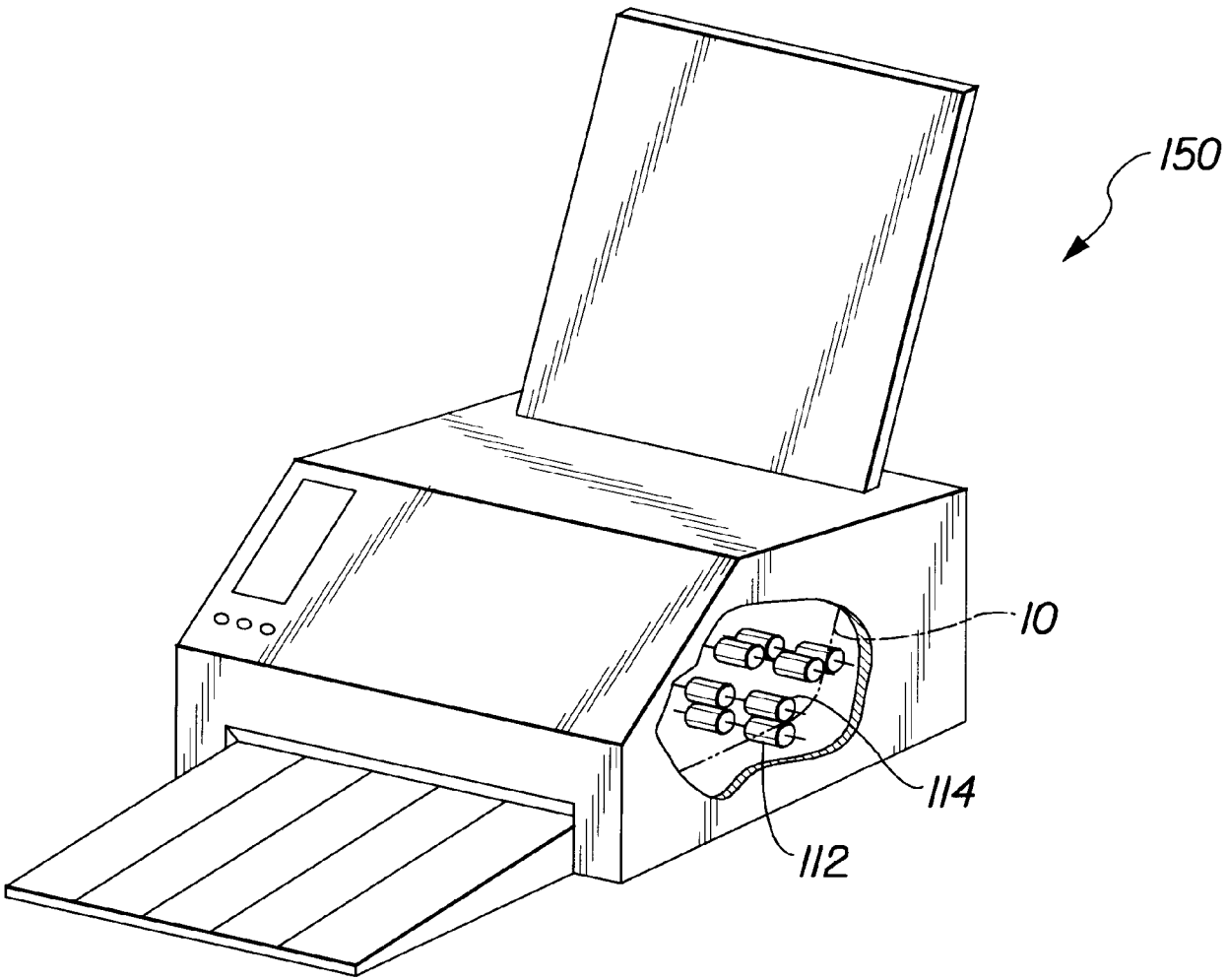
FIG. 6 illustrates a printer.
Figure 7:
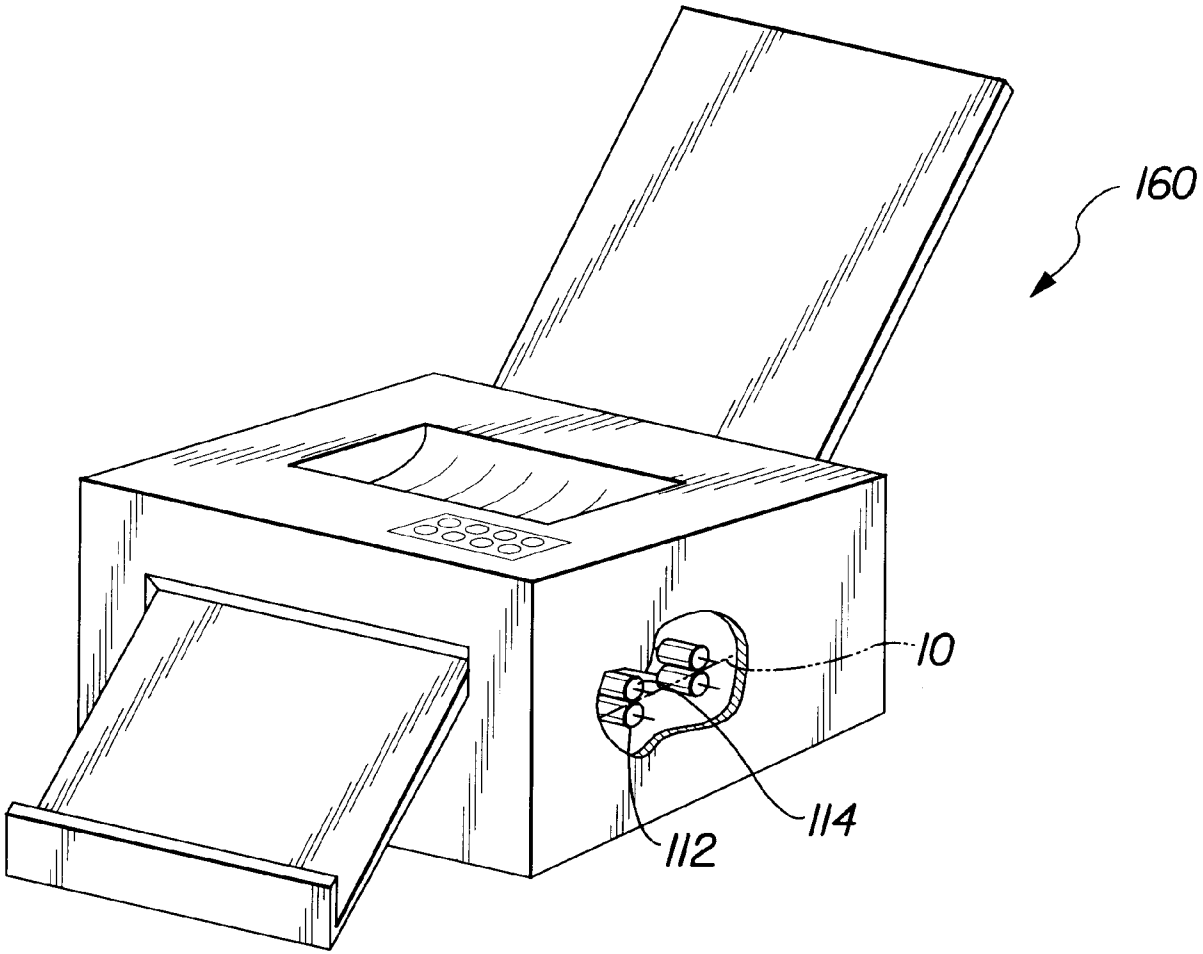
FIG. 7 illustrates a facsimile machine.
Figure 8:
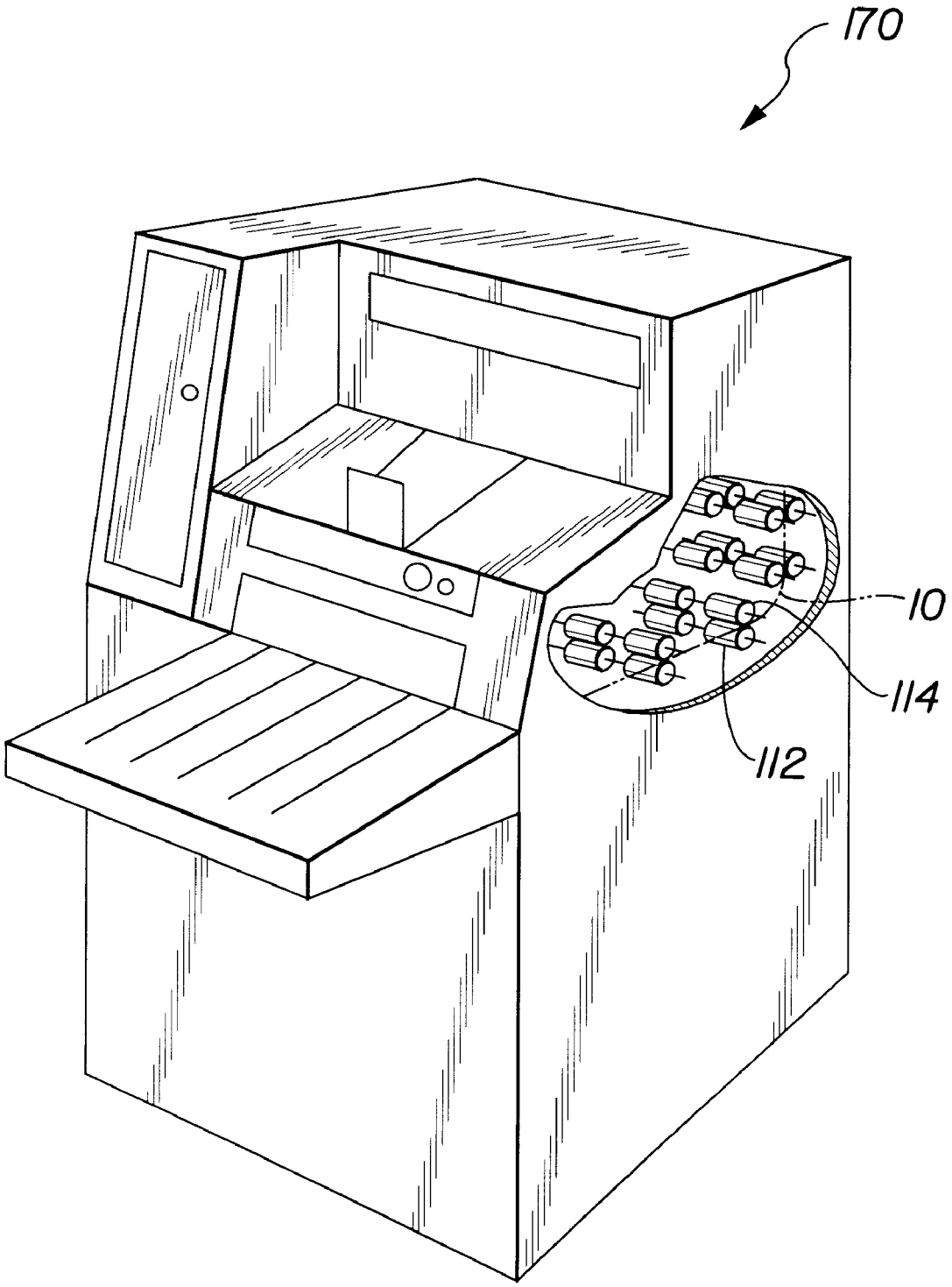
FIG. 8 illustrates a microfilmer.

Other aspects of the present invention provide a printer 150 (see FIG. 6), facsimile machine 160 (see FIG. 7), and microfilmer 170 (see FIG. 8) having the same effect as the first through third aspects of the present invention.

What is claimed is:

1. A sheet transport apparatus comprising:

a non-spherical one-piece first friction member for transport, said first friction member having a dimension greater at an intermediate portion compared to other portions thereof, so as to define a convex surface on the exterior thereof; and a second friction member for transport having a concave surface on the exterior thereof matingly abutted against the convex surface of said first friction member for transport, said first and second friction members nipping a sheet of paper therebetween and rotating together to transport the sheet of paper; wherein a nipping pressure applied to a nipping face between said first and second friction members for nipping said sheet of paper decreases gradually from a center of said second friction member to an outer periphery of said second friction member.

2. A sheet transport apparatus according to claim 1, wherein:

said first friction member is a transport roller having an axis and a diameter greater at an intermediate position of the transport roller along its axis than in other positions, and said second friction member is an elastic body.

3. A sheet transport apparatus according to claim 1, wherein:

said first friction member is a transport belt having a thickness greater at an intermediate position of the transport belt in a widthwise direction than in other positions, and said second friction member for transport is an elastic body.

4. A copying machine utilizing a sheet transport apparatus according to claim 1.

5. A copying machine utilizing a sheet transport apparatus according to claim 2.

6. A copying machine utilizing a sheet transport apparatus according to claim 3.

7. A scanner utilizing a sheet transport apparatus according to claim 1.

8. A scanner utilizing a sheet transport apparatus according to claim 2.

9. A scanner utilizing a sheet transport apparatus according to claim 3.

10. A printer utilizing a sheet transport apparatus according to claim 1.

11. A printer utilizing a sheet transport apparatus according to claim 2.

12. A printer utilizing a sheet transport apparatus according to claim 3.

13. A facsimile machine utilizing a sheet transport apparatus according to claim 1.

14. A facsimile machine utilizing a sheet transport apparatus according to claim 2.

15. A facsimile machine utilizing a sheet transport apparatus according to claim 3.

16. A microfilmer utilizing a sheet transport apparatus according to claim 1.

17. A microfilmer utilizing a sheet transport apparatus according to claim 2.

18. A microfilmer utilizing a sheet transport apparatus according to claim 3.

* * * * *